United States Patent [19]

Levercom

[11] 4,391,311

[45] Jul. 5, 1983

[54] LOG SPLITTING DEVICE

[76] Inventor: Warren Levercom, 3901 Main St. NE., Blaine, Minn. 55434

[21] Appl. No.: 244,251

[22] Filed: Mar. 16, 1981

[51] Int. Cl.[3] ..... B27L 7/00

[52] U.S. Cl. ..... 144/193 D

[58] Field of Search ..... 144/193 R, 193 C, 193 D; 254/104

[56] References Cited

U.S. PATENT DOCUMENTS

| | | | |
|---|---|---|---|
| 3,982,572 | 9/1976 | Kortendick | 144/193 R |
| 4,033,390 | 7/1977 | Piontkowski | 144/193 R |
| 4,211,264 | 7/1980 | Cross | 144/193 R |
| 4,274,458 | 6/1981 | Dueweke et al. | 144/193 R |

*Primary Examiner*—W. D. Bray

[57] ABSTRACT

A splitting blade having a wedge disposed at its midpoint with the cutting surface extending below the splitting blade, the splitting blade being slideably connected between upright tubular metal rails. The rails are secured to a metal base plate by short metal tubes, which also act as a stop for the wedge. A log to be split is placed between the wedge and base plate and a maul is used to drive the wedge into the log, until the splitting blade also engages the log and causes easy splitting thereof.

9 Claims, 6 Drawing Figures

FIG. 1.
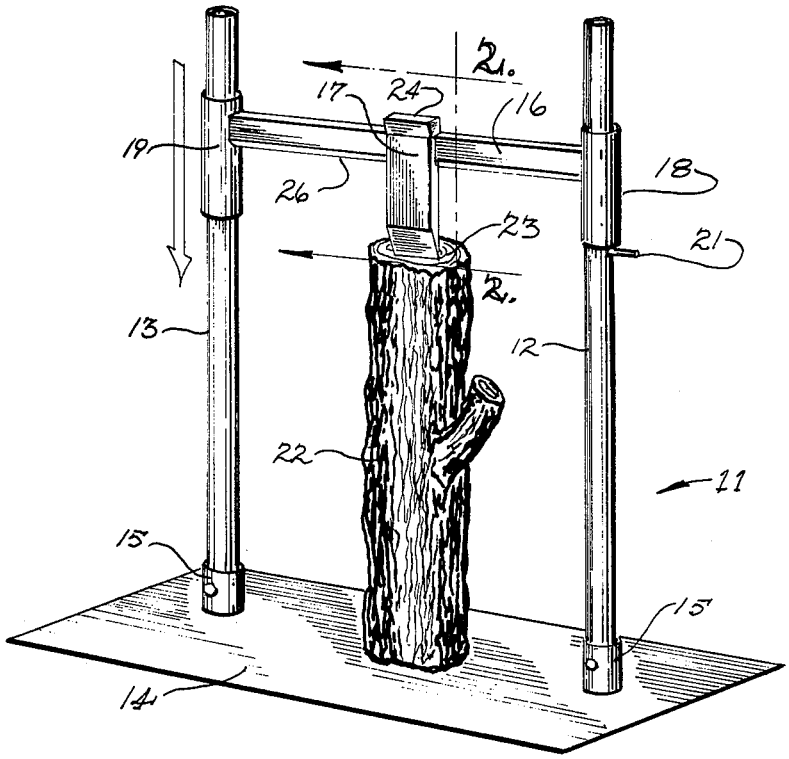
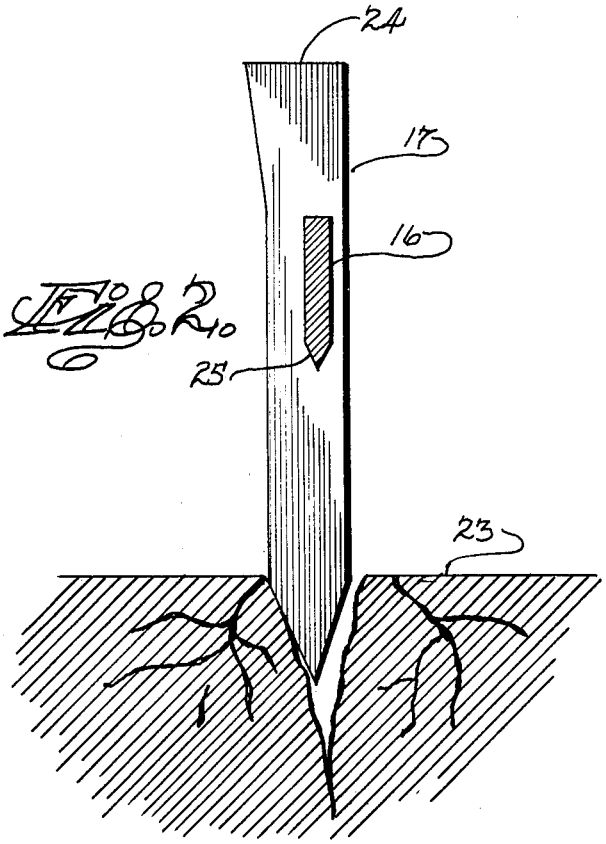
FIG. 2.
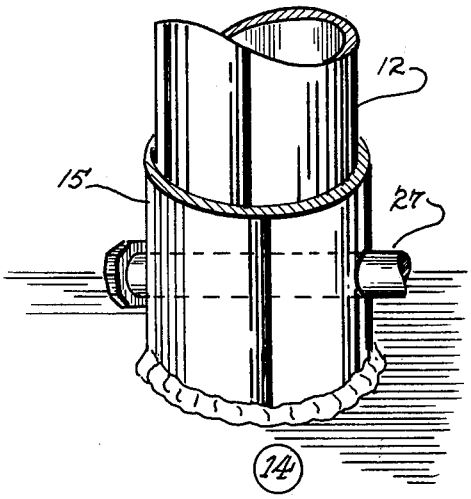
FIG. 3.

FIG. 4.
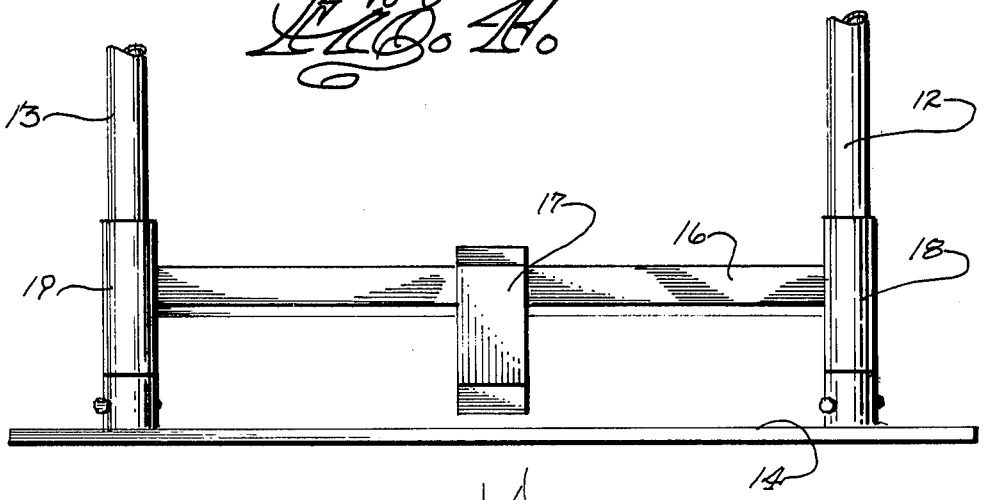
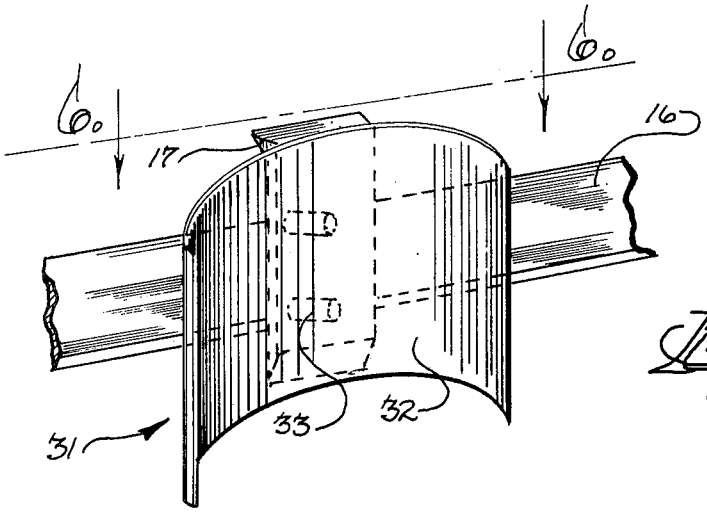
FIG. 5.
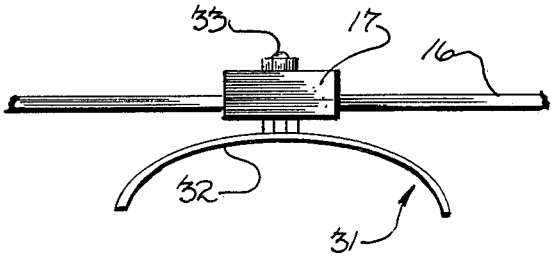
FIG. 6.

LOG SPLITTING DEVICE

BACKGROUND OF THE INVENTION

This invention relates to log splitters and, more particularly, to a log splitting device using a splitting blade and wedge.

A variety of tools and devices are used to split logs, including axes, wedges and mauls, and numerous power driven devices, such as powered augers and the like. Axes or mauls and wedges are probably the simplest and least expensive tools, but offer the obvious problem of potential harm to the user due to accidents. Also, they require a great deal of physical effort to split even a few logs, not to mention a half or full cord.

The power driven devices are much more expensive than axes and wedges, but also can be dangerous to the user, and must be cautiously employed. Although power driven devices are adequate for rapidly splitting a great number of logs, they are often not readily adaptable for cutting kindling or other thin pieces of logs. Moreover, powered devices are usually cumbersome to use and cannot be easily transported from one site to another.

More recently, there has been developed a log splitter in which a wedge is slideably secured to a steel guide channel which can be positioned adjacent a log, allowing the user to hammer the wedge into a log place upright between the wedge and the base plate of the device. However, this device has not proven to be fully satisfactory, especially as to ease of cutting logs.

SUMMARY OF THE INVENTION

In accordance with this invention there is provided a log splitting device comprising a pair of upright rails spaced apart and parallel to one another, a splitting blade slideably connected between the rails, a wedge secured to the splitting blade and extending below the lower level of the splitting blade with its splitting surface facing downward, and a base plate adapted for securing the rails in upright position. The splitting blade is raised above the base plate and a log is placed upright between the wedge and the base plate, following which a sledge or maul can be used to drive the wedge into the log. After the wedge has entered the log to a certain depth the splitting blade also engages the log, and both wedge and splitting blade quickly and effortlessly act to split the log.

It is a primary object of this invention to provide a log splitting device which can be manually used to easily and quickly split logs into slab pieces or the finest of kindling.

It is another object of this invention to provide a log splitting device with built-in safety features which virtually eliminate potential injury from accidents, making the device all but accident proof.

It is a further object of this invention to provide a log splitting device having removable cutting and splitting elements for sharpening, storage or transportation by a single user.

It is a still further object of this invention to provide a log splitting device which allows truer splitting of logs.

It is a yet further object of this invention to provide a log splitting device easy to assemble and disassemble.

BRIEF DESCRIPTION OF THE DRAWINGS

FIG. 1 is a perspective view of the log splitting device of this invention;

FIG. 2 is a view taken along line 2—2 of FIG. 1, showing the splitting blade and wedge assembly;

FIG. 3 is an enlarged partial view of the short metal tubes of the base plate;

FIG. 4 is a view similar to that of FIG. 1, showing the splitting blade and wedge in lowered position;

FIG. 5 is a perspective view of a bark cutter for securement to the wedge of the log splitting device; and FIG. 6 is a plan view of the bark cutter shown in FIG. 5.

DESCRIPTION OF THE PREFERRED EMBODIMENT

Referring to FIG. 1 of the drawings, log splitting device 11 has a pair of vertically disposed rails 12, 13 secured to base plate 14 by means of short metal tubes 15, as will be shown in more detail in FIG. 3. Slideably connected across the rails 12, 13 is splitting blade 16, which has secured at its midpoint wedge 17. The splitting blade and wedge assembly can be slided up and down the rails 12, 13 by means of short metal tubes 18, 19, which receive the rails with sufficient slack such that there is no sticking during raising or lowering.

As shown in FIG. 1, the splitting blade and wedge assembly, 16, 17, 18, 19, is maintained in raised position by means of pin 21 which is inserted through holes (not shown) in rail 12. Log 22 is placed on base plate 14 directly beneath wedge 17, after which pin 21 is removed and the wedge assembly lowered into contact with the upper surface 23 of the log. The user then strikes top surface 24 of wedge 17 with a maul or sledge hammer, driving the wedge into the log. Splitting blade 16 is provided with a cutting edge 26 along its lower surface, such that when the wedge has been driven to a given depth into the log the cutting edge 26 will also engage the log, greatly increasing the splitting action of the device, and resulting in rapid and near effortless splitting of the largest logs.

FIG. 2 shows in cross-sectional view the wedge 17 and splitting blade 16 of the log splitting device, with the cutting end of the wedge having entered log 22. Splitting blade 16 has a lower edge 25 bevelled at a 45 degree angle, which allows the splitting blade to cut into and split the log after the wedge has been driven a certain depth into the log, as described above. The splitting blade preferably has a thickness of about one quarter inch, and a depth of about two or three inches. Also, splitting blade 16 provides the optimum splitting action when it is straight across from one rail to the other. The span of the splitting blade is about twenty two inches. A conventional steel wedge, having dimensions of two inches by ten and one half inches, can be used in this invention, and welded to a pair of splitting blades, one on either side of the wedge. Or a single splitting blade can be employed, with the wedge integrally formed with the splitting blade, at the midpoint thereof.

FIGS. 3 and 4 illustrate an important safety feature of the log splitting device 11. Short metal tubes 15 are welded to base plate 14, and have a diameter sufficient to receive rails 12, 13. Each such tube has a pair of aligned holes for receiving bolts 27, which also pass through similarly aligned holes in the bottom ends of rails 12, 13, such that the rails can be firmly secured to the base plate 14, and yet can be easily and quickly disconnected therefrom by a single workman. Short tubes 15 have the same diameter as the short tubes 18, 19 of the splitting blade and wedge assembly, such that when the assembly is lowered as far as possible the two pairs of short tubes will contact one another and prevent the wedge from coming into contact with base plate 14, preferably at a distance of about four inches therefrom. As a consequence, a user will never have to worry about the splitting blade and wedge assembly catching a foot or hand on the base plate.

Rails 12, 13 can be formed of heavy wall steel pipe, referred to as "standard pipe." The short metal tubes 18, 19 of the splitting blade and wedge assembly receive the rails losely, preferably with a slack of about one eighth inch all around. The slackness prevents jamming of the assembly, thereby assuring trouble free operation of the log splitting device. That is, there is no need to force the assembly into position; the only force necessary will be to drive the wedge and splitting blade into the log.

Base plate 14 has a length of about thirty three inches and a width of about eighteen inches, and is about one quarter inch thick. These dimensions make the device almost impossible to tip over, another important safety feature of the invention. Also, the base plate has a flat upper surface, without a spike or other projection, which is unnecessary to hold a log in position. This allows for truer splitting of logs, which would otherwise be forced by the spike into unnatural splitting, making the splitting more difficult and increasing the possibility of a piece of the wood flying out and striking someone.

FIGS. 5 and 6 show a bark cutter attachment 31 for wedge 17. Semi-cylindrical blade 32 can be secured by bolts 33 to wedge 17, as shown, or the attachment could be secured to the splitting blade 16 if desired.

I claim:

1. A log splitting device comprising:

a pair of vertical rails spaced apart and parallel to one another, a splitting blade slideably connected between the rails, a wedge secured to the splitting blade and extending below the lower level thereof with its cutting surface facing downward, and a base plate adapted for securing the rails in vertical position with the splitting blade mounted thereon.

2. The log splitting device of claim 1 wherein the rails are metal tubes and the splitting blade has short metal tubes at its ends for slidably receiving the tubular rails such that the splitting blade and wedge assembly can be mounted on the rails or removed therefrom by slideably moving the short tubes on the rails.

3. The log splitting device of claim 2 wherein one of the tubular metal rails has a pair of aligned holes near its upper end, and additionally comprising a metal pin insertable through the holes to hold the splitting blade in raised position above the base plate.

4. The log splitting device of claim 2 wherein both tubular rails have aligned holes near their bottom ends, wherein the base plate has a pair of short metal tubes for receiving the tubular rails, and bolts for insertion through the holes of the rails and similarly aligned holes on the short metal tubes of the base plate, for securing the rails in upright position on the base plate.

5. The log splitting device of claim 4 wherein the short tubes of the base plate extend upwardly to a height such that the wedge will be at least four inches above the surface of the base plate when the splitting blade and wedge assembly have been lowered into stop position in contact with the short tubes of the base plate.

6. The log splitting device of claim 1 wherein the wedge is secured to the splitting blade at its approximate midpoint, with the upper surface of the wedge being flat, such that the wedge can be driven by a maul or hammer into a log placed on end beneath the wedge.

7. The log splitting device of claim 6 wherein the splitting blade has a gap at its approximate mid point, and wherein the wedge is welded into position within such gap.

8. The log splitting device of claim 7 wherein the splitting blade is perpendicular to the rails, has a height of about two inches, a thickness of about one quarter inch, and a bevelled cutting edge on its lower surface, and wherein the wedge is approximately four inches across, two inches thick and ten inches deep, and the cutting surface of the wedge is approximately four inches below the splitting blade, and wherein the base plate covers a rectangular area of about four square feet.

9. The log splitting device of claim 1 additionally comprising a semi-cylindrical blade adapted for bolting over the wedge to allow the cutting of bark from logs.

* * * * *